United States Patent [19]

Tanaka et al.

[11] Patent Number: 4,891,398

[45] Date of Patent: Jan. 2, 1990

[54] FIBER TREATMENT COMPOSITION

[75] Inventors: Masaki Tanaka; Hiroshi Ohashi, both of Annaka, Japan

[73] Assignee: Shin-Etsu Chemical Co., Ltd., Tokyo, Japan

[21] Appl. No.: 231,471

[22] Filed: Aug. 12, 1988

[30] Foreign Application Priority Data

Aug. 14, 1987 [JP] Japan ..... 62-202757

[51] Int. Cl.[4] ..... C08K 5/54

[52] U.S. Cl. ..... 524/188; 524/262; 524/731; 524/747; 524/745; 524/759; 524/760

[58] Field of Search ..... 524/188, 262, 731, 745, 524/747, 759, 760

[56] References Cited

U.S. PATENT DOCUMENTS 4,311,737 1/1982 Ishizaka et al. ..... 524/262

*Primary Examiner*—Melvyn I. Marquis

*Attorney, Agent, or Firm*—Oblon, Spivak, McClelland, Maier & Neustadt

[57] ABSTRACT

A fiber treatment composition comprising an aqueous dispersion containing;

(A) 100 parts by weight of a finely particulate epoxy group-containing organosilasesquioxane substantially represented by general unit formula (I):

$$R^1SiO_{3/2} \quad (I)$$

wherein said organic group having an epoxy group comprises from 0.1 to 50 mol % of the whole $R^1$; and;

(B) from 10 to 900 parts by weight of an amino group-containing organopolysiloxane represented by general unit formula (II):

$$(R^2)_aZ_bSiO_{\frac{4-a-b}{2}} \quad (II)$$

wherein $R^2$ is a monovalent hydrocarbon group having 1 to 20 carbon atoms, an alkoxy group or a hydroxyl group; Z is a particular amino group; and $1<a<3$, $0<b<1$ and $1<a+b<3$. This composition is useful for deepening colors of dyed textiles and fabrics and improving softness and feeling, even with respect to synthetic fibers.

9 Claims, No Drawings

FIBER TREATMENT COMPOSITION

BACKGROUND OF THE INVENTION

1. Field of the Invention

This invention relates to a fiber treatment composition, and particularly to a fiber treatment composition useful for deepening colors of dyed goods even with respect to synthetic fibers such as polyesters, and for improving softness and feeling of the fibers.

2. Description of the Prior Art

Pointed out as disadvantages of most of synthetic fibers, particularly polyester synthetic fibers, are the fact that they are dyed with a low color deepness and a poor color sharpness as compared with natural fibers such as wool and silk and particular other synthetic fibers such as nylons and acrylic fibers, and that synthetic fibers generally have poor softness and feeling as compared with natural fibers.

Various methods have been hitherto proposed as methods for eliminating these disadvantages.

For example, to deepen colors of dyed goods, known are;

a method in which a moiety at which a cationic dye is adsorbed, such as a sulfonic acid group, is introduced in a polymer of the fibers;

a method in which an organic resin having a refractive index of 1.50 or less is formed by a plasma polymerization method or an electrical discharge grafting method to deepen colors of dyed goods (Japanese Patent Publication (KOKOKU) No. 35309/1986;

a method in which fiber surfaces are etched to form uneveness thereon and thereafter coated with a resin which is transparent and has a low refractive index (Japanese Patent Publication (KOKOKU) No. 37225/1985;

a method in which treatment is carried out using fine particles of inorganic oxides and a polymeric silicone compound (Japanese Unexamined Patent Publication (KOKAI) No. 71475/1982); etc.

However, the method in which a sulfonic acid group or the like is introduced in the fiber polymer can achieve only an insufficient color-deepening effect. The method in which plasma or electrical discharge is employed has the disadvantage that it requires a special apparatus and can not be simply operated, and also can achieve only an insufficient fiber-softening effect. The method disclosed in Japanese Unexamined Patent Publication (KOKAI) No. 71475/1982 is a method in which a powder of non-reactive inorganic oxides is applied on the fiber surfaces by using a reactive silicone resin, but problems are pointed out such that turbidity is caused after treatment because of insufficient affinity between the both components or that treatment non-uniformity occurs because of unstableness of treatment solutions.

SUMMARY OF THE INVENTION

Accordingly, an object of this invention is to provide a fiber treatment composition superior in color-deepening effect to dyed synthetic fibers by a simple treatment and effect of imparting soft feeling, and yet having durability for such effect.

As a means for achieving the above object, this invention provides a fiber treatment composition comprising an aqueous dispersion containing:

(A) 100 parts by weight of a finely particulate epoxy group-containing organosilasesquioxane substantially represented by general unit formula (I):

$$R^1SiO_{3/2} \qquad (I)$$

wherein $R^1$ is selected from the group consisting of a monovalent hydrocarbon group having 1 to 20 carbon atoms which may be substituted with a halogen atom, and a monovalent organic group having an epoxy group, and said organic group having an epoxy group comprises from 0.1 to 50 mol % of the whole $R^1$; and;

(B) from 10 to 900 parts by weight of an aminogroup-containing organopolysiloxane represented by general unit formula (II):

$$(R^2)_aZ_bSiO_{\frac{4-a-b}{2}} \qquad (II)$$

wherein $R^2$ is at least one selected from the group consisting of a monovalent hydrocarbon group having 1 to 20 carbon atoms which may be substituted with a halogen atom and a group represented by the formula $-OR^3$ where $R^3$ is an alkyl group having 1 to 5 carbon atoms or a hydrogen atom; Z is a group represented by formula (III):

$$-R^4-\overset{\overset{R^5}{|}}{N}\left(CH_2CH_2\overset{\overset{R^6}{|}}{N}\right)_cR^7 \qquad (III)$$

where $R^4$ is a divalent hydrocarbon group having 1 to 6 carbon atoms, $R^5$, $R^6$ and $R^7$ may be the same or different and each are a hydrogen atom or a monovalent hydrocarbon group having 1 to 20 carbon atoms, and c is an integer of 0 to 3; and a and b are numbers satisfying $1<a<3$, $0<b<1$ and $1<a+b<3$; and having at least one said group Z in its molecule.

The fiber treatment composition of this invention can be applied on textiles, particularly textiles made of synthetic fibers including polyesters, to achieve deepening and sharpening colors of dyed textiles in a high uniformity, and also can exhibit superior effect in the improvement in feeling by softening. Moreover, such effect is resistant to washing. The composition can be very readily and simply applied to the textiles.

DETAILED DESCRIPTION OF THE PREFERRED EMBODIMENTS

In the component (A) organosilasesquioxane in the composition of this invention, the $C_1$ to $C_{20}$ hydrocarbon group represented by $R^1$ may include, for example, alkyl groups such as a methyl group, an ethyl group, a propyl group, a butyl group, an isobutyl group, an amyl group, a hexyl group, an octyl group, a decyl group, a dodecyl group and an octadecyl group; alkenyl groups such as a vinyl group, an allyl group and a butenyl group; aryl groups such as a phenyl group and a naphthyl group; aralkyl groups such as a benzyl group; arylcycloalkyl group such as a phenylcyclohexyl group; alkaryl groups such as a tolyl group, a xylyl group, an ethylphenyl group and a methylphenyl group; cycloalkyl groups such as a cyclopentyl group, a cyclohexyl group and a cyclobutyl group. These may be substituted with a halogen atom such as a fluorine atom, a chlorine atom or a bromine atom. The organic group having an epoxy group, which can be represented by $R^1$, may include, for example;

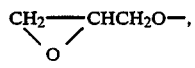

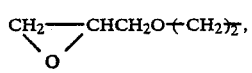

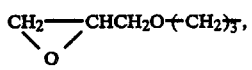

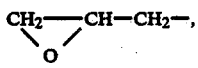

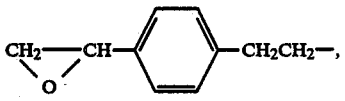

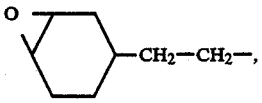

particularly desirably a glycidoxypropyl group and a beta-(3,4-epoxycyclohexyl)ethyl group.

Of $R^1$ in formula (I), from 0.1 to 50 mol %, preferably from 0.5 to 10 mol %, is held by the above organic group having an epoxy group. This epoxy group containing organic group otherwise less than 0.1 mol % may result in insufficiency of the reactivity with the component (B) aminogroup-containing organopolysiloxane, making it impossible to form a good coating to bring about the disadvantage that no durability can be exhibited. The same otherwise more than 50 mol % may cause the difficulty that a treated fabric has a hard feeling.

This component (A) organosilasesquioxane comprises particles having a particle diameter preferably of 0.5 micrometer or less, more preferably from 0.01 to 0.3 micrometer. The particle diameter otherwise larger than 0.5 micrometer may result in readiness in agglomeration of the silasesquioxane on a treated fabric, sometimes causing the disadvantage that there is brought about a state that a treated fabric has a white powder in appearance.

In the component (B) amino group-containing organopolysiloxane in the composition of this invention, examples of the $C_1$ to $C_{20}$ hydrocarbon group represented by $R^2$ in formula (II) include those exemplified in regrad to the above $R^1$. The alkoxy group represented by the formula $-OR^3$ is exemplified by a methoxy group, an ethoxy group, a propoxy group, a butoxy group and a pentyloxy group. To keep in a good state the soft feeling of a treated fabric, 50 mol % or more, particularly 80 mol % or more, of $R^2$ may desirably be held by a methyl group.

The component (B) aminogroup-containing organopolysiloxane has at least one amino group Z represented by formula (III). In the above formula (III), the divalent hydrocarbon group represented by $R^4$ may include, for example, an alkylene group having 1 to 6 carbon atoms, more specifically, $-CH_2CH_2-$, $-CH_2CH_2CH_2-$, $-(CH_2)_4-$ and $-(CH_2)_6-$. $R^5$, $R^6$ and $R^7$ each represent a hydrogen atom or a hydrocarbon group having 1 to 20 carbon atoms, and examples of the hydrocarbon group having 1 to 20 carbon atoms may include those exemplified in regard to the above $R^1$. Specific examples of the amino group Z represented by formula (III) may include;

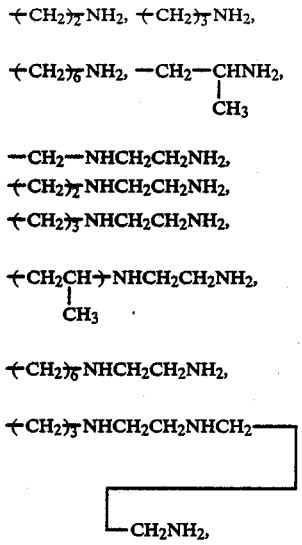

Also, specific examples of the component (B) amino group containing organopolysiloxane are exemplified by the following:

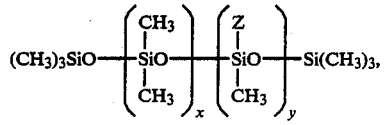

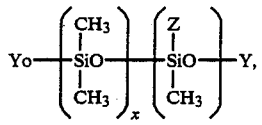

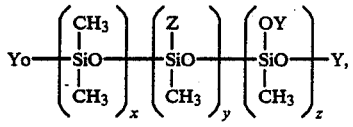

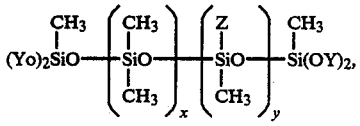

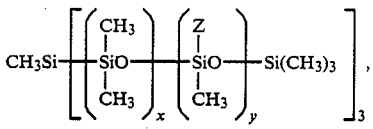

-continued

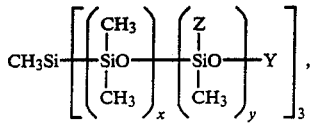

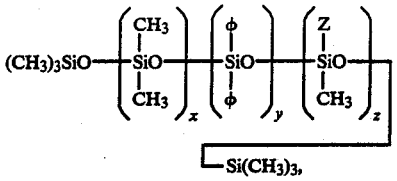

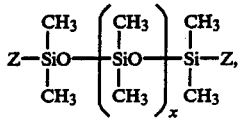

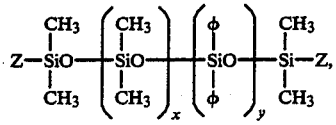

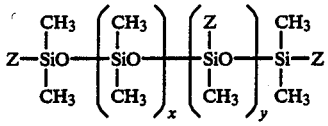

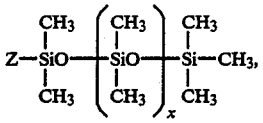

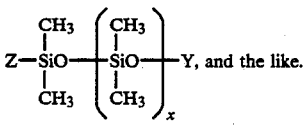

In the above formulas, Y is H or $CH_3$, $C_2H_5$ or the like, Z is $-(CH_2)_3$, $-NH_2$, $-(CH_2)_3NHCH_2CH_2NH_2$ or the like.

The composition of this invention may preferably be prepared by separately preparing an aqueous dispersion containing the component (A) organosilasesquioxane and an aqueous dispersion containing the component (B) amino group-containing organopolysiloxane, and mixing in a given proportion usually when used.

The aqueous dispersion containing the component (A) organosilasesquioxane is prepared, for example, by using a hydrolyzable silane represented by the formula:

$$R^1SiX_3$$

wherein $R^1$ is as defined above, X is, for example, a hydrolyzable organic group such as an alkoxy group, an alkoxyalkoxy group and an acetyl group; and/or partialhydrolysis-condensation products thereof as a starting material, which is emulsified with stirring in the presence of any combination of a cationic emulsifying agent with a nonionic emulsifying agent or an anionic emulsifying agent with a nonionic emulsifying agent, and thereafter adding an alkaline material in a suitable amount as a catalyst for condensing the above hydrolyzable organic group to carry out polymerization, followed by neutralization and removal of the alkaline material with use of an acidic material.

In the above preparation process, any combination of the cationic emulsifying agent/nonionic emulsifying agent or the anionic emulsifying agent/nonionic emulsifying agent is selected for the reason that employment of only a cationic or anionic emulsifying agent may result in progress of abrupt condensation gelation when an alkaline catalyst is added. Using the cationic emulsifying agent or anionic emulsifying agent in combination with a nonionic emulsifying agent can prevent the condensation gelation to obtain a uniform aqueous dispersion. The organosilasesquioxane in this aqueous dispersion is substantially transparent, and particles are very fine as having a particle size usually of 0.5 micrometer or less.

Specific examples of the above hydrolyzable silane used in the above process may include;

$CH_3Si(OCH_3)_3$,
$CH_3Si(OC_2H_5)_3$,
$CH_3Si(OC_3H_7)_3$,
$CH_3Si(OC_4H_9)_3$,
$CH_3Si(OCOCH_3)_3$,
$CH_2{=}CHSi(OCOCH_3)_3$,
$CF_3CH_2CH_2Si(OCH_3)_3$,
$CH_3Si(OCH_2CH_2OCH_3)_3$,
$C_2H_5Si(OCH_3)_3$,
$C_2H_5Si(OC_2H_5)_3$,
$C_3H_7Si(OCH_3)_3$,
$C_4H_9Si(OCH_3)$,
$C_5H_{11}Si(OCH_3)_3$,

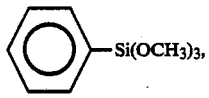

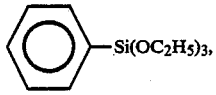

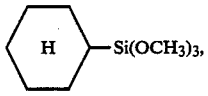

$C_8H_{17}Si(OCH_2)_3$,
$C_{12}H_{25}Si(OCH_3)$,
$CH_2{=}CHSi(OCH_3)_3$,
$CH_2{=}CHSi(OC_2H_5)_3$,
$CH_2{=}CHCH_2Si(OCH_3)_3$,

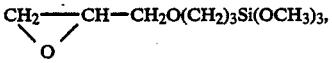

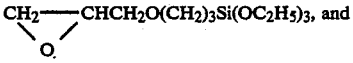

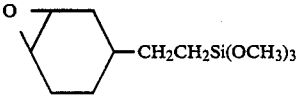

and may be selected and used so that a given proportion of $R^1$ may be held by the organic group having an epoxy group.

The above preparation can also be carried out by optionally mixing every sort of carbon functional trialkoxysilane into the above hydrolyzable silane so long as the object of this invention may not be injured, and such a carbon functional trialkoxysilane may include, for example, $HSi(OCH_3)_3$, $$CH_2{=}\overset{\overset{\displaystyle CH_3}{|}}{C}{-}COO(CH_2)_3Si(OCH_3)_3,$$

$H_2N(CH_2)_2NH(CH_2)_3Si(OCH_3)_3$,
$Cl(CH_2)_3Si(OCH_3)_3$,
$SH(CH_2)_3Si(OCH_3)_3$, and
$H_2N(CH_2)_3Si(OC_2H_5)_3$.

Also, the cationic emulsifying agent to be used is exemplified by agents such as an alkyltrimethylammonium chloride, an alkylbenzylammonium chloride and a dialkyldimethylammonium bromide, but by no means limited to these, which may include any known agents, or may further be used in combination of two or more kinds of them. There is no particular limitation on the amount of this cationic emulsifying agent so long as the stability of the aqueous organosilasesquioxane dispersion and properties thereof are not inhibited, but it may preferably ranges from 10 to 30% by weight based on the organosilasesquioxane obtained.

The anionic emulsifying agent that can be used is exemplified by sulfuric acid ester salts represented by $ROSO_3M$ (wherein R is a monovalent hydrocarbon group having 6 to 20 carbon atoms, and M is an alkali metal such as Na or K), sodium lauryl sulfate, sodium octadecyl sulfate, sodium polyoxyethylene dodecyl sulfate, alkylbenzene sulfonates such as sodium dodecylbenzenesulfonate, sodium alkylnaphthalene sulfonates, sodium dialkylsulfosuccinates, and sodium alkyl diphenyl ether disulfonates.

The nonionic emulsifying agent used in combination with the above cationic or anionic emulsifying agent is exemplified by polyoxyethylene alkyl ethers, polyoxyethylene alkyl phenyl ethers, polyoxyethylene alkyl esters, sorbitan fatty acid esters, polyoxyethylene sorbitan fatty acid esters, and sugar fatty acid esters, but by no means limited to these, and there can be used other known various nonionic emulsifying agents. These nonionic emulsifying agents may be used alone or in combination of two or more ones. However, employment of the nonionic emulsifying agent whose HLB is outside the range of from 16 to 20 may result in no effect to be obtained when used in combination with the above cationic emulsifying agent or anionic emulsifying agent, bringing about the disadvantages such that gelled products are produced in a large amount at the time of polycondensation reaction. Accordingly, this is required to comprise one or more kinds having an HLB of 16 to 20. Also, if added in an amount of less than 5% by weight based on the organosilasesquioxane obtained, sufficient effect cannot be obtained in using this nonionic emulsifying agent in combination with the cationic or anionic emulsifying agent, resulting in difficulty in the preparation of the aqueous dispersion, and the formation of the organosilasesquioxane requires an extremely long time if added in an amount more than 50% by weight. Accordingly, this is required to be added in an amount of from 5 to 50% by weight, preferably from 10 to 30% by weight.

As the alkaline catalyst to be used, there may be used, for example, potassium hydroxide, sodium hydroxide, ribidium hydroxide, sodium carbonate, and tetraalkylammonium hydroxides. There is no particular limitation on the amount for addition, but this may suitably be added in the range of from 10 to 30% by weight based on organosilasesquioxane.

Actual preparation of the aqueous organosilasesquioxane dispersion can be carried out by first uniformly dispersing the organosilane and/or partial-hydrolysis-condensation products thereof, together with a given amount of the cationic emulsifying agent or anionic emulsifying agent and the nonionic emulsifying agent, in water with use of a homomixer, a colloid mill, a homogenizer or the like.

Next, an alkaline condensation catalyst is added in the resulting emulsified dispersion, and the mixture may be heated for 1 to 10 hours at 20° to 70° C., followed by neutralization of the alkaline material, thus readily obtaining a stable aqueous organosilasesquioxane dispersion without any generation of gelled products. The aqueous organosilasesquioxane dispersion thus obtained is a stable emulsion whose organosilasesquioxane particles have a particle diameter generally as small as from 0.05 to 0.5 micrometer and also have a narrow particle size distribution.

On the other hand, the aqueous dispersion containing the component (B) amino group-containing organopolysiloxane is well known to those who are skilled in the art, and can be prepared by several known methods.

More specifically it can be readily prepared by a method in which, for example, octamethylcyclotetrasiloxane, an aminoalkoxysilane represented by the formula:

$$H_2N(CH_2)_2NH(CH_2)_3\overset{\overset{\displaystyle CH_3}{|}}{Si}(OCH_3)_2$$

and/or hydrolysis-condensation products thereof and a small amount of hexamethyldisiloxane optionally used, are subjected to polymerization by heating in the presence of a strongly alkaline catalyst as exemplified by potassium hydroxide, sodium hydroxide and tetramethylammonium hydroxide to obtain a liquid amino group-containing organopolysiloxane, followed by neutralization and removal of the alkaline used as a catalyst, thereafter low boiling substances are removed if necessary to obtain an oily product, and then said oily product is dispersed in water with use of a suitable nonionic and/or cationic emulsifying agent(s). [This is hereinafter referred to as method (1).]

Examples of the nonionic emulsifying agent and cationic emulsifying agent used in the above method (1) may include those exemplified in regard to the preparation of the aqueous dispersion of component (A). In the present method (1), the aqueous dispersion can be adjusted to have the pH in the range of from 3 to 7 by using formic acid, acetic acid, glycolic acid, hydrochloric acid or the like to make stable the resulting aqueous dispersion and make mild the basicity of the amino group-containing organopolysiloxane.

Another method for preparing the aqueous dispersion containing the component (B) amino group-containing organopolysiloxane includes a method in which, for example, octamethylcyclotetra-siloxane, an aminoalkoxysilane represented by the formula:

$$H_2N(CH_2)_2NH(CH_2)_3\overset{\overset{\displaystyle CH_3}{|}}{Si}(OCH_3)_2$$

and/or hydrolysis-condensation products thereof and a siloxane, optionally added, having a trimethylsilyl group, such as hexamethyldisiloxane are dispersed in water in the presence of a cationic emulsifying agent and a nonionic emulsifying agent, and thereafter a suitable amount of a strongly alkaline catalytic material is added, followed by heating to obtain a desired aqueous dispersion. [This is hereinafter referred to as method (2).]

Examples of the cationic emulsifying agent and nonionic emulsifying agent used in the above method (2) may include those exemplified in regard to the preparation of the aqueous dispersion of component (A), and usable as the strongly alkaline catalyst are those exemplified in regard to method (1). Then, the strongly alkaline catalyst in the resulting aqueous dispersion is removed by neutralization with an acid.

This method (2) has the advantages that the resulting aqueous dispersion has a high stability and a product having a high polymerization degree is produced as the amino group-containing organopolysiloxane in the dispersion.

In method (2), a stable aqueous dispersion usually containing an amino group-containing and long-chain organopolysiloxane can be usually obtained, but an emulsion containing an amino group-containing organopolysiloxane having cross-linkability can be obtained by mixing a trace amount of a suitable trialkoxysilane as exemplified by $CH_3Si(OCH_3)_3$, $CH_3Si(OC_2H_5)_3$, $C_6H_5Si(OC_2H_5)_3$, $H_2N(CH_2)_2NH(CH_2)_3Si(OCH_3)_3$ and $H_2N(CH_2)_3Si(OC_2H_5)_3$ to effect copolymerization, thus making it possible to improve coating-formation properties on a fabric and durability of the treatment effect thereon.

The aqueous dispersion containing the component (A) organosilasesquioxane and the aqueous dispersion containing the component (B) amino group-containing organopolysiloxane are usually blended just before they are used, to prepare the fiber treatment composition of this invention, and used after the composition is optionally diluted with water to make adjustment of concentration. In the composition of this invention, the component (A) and the component (B) are used in the proportion of from 10 to 900 parts by weight, preferably from 50 to 300 parts by weight, of component (B) per 100 parts by weight of component (A). Component (B) otherwise less than 10 parts by weight makes it impossible to expect sufficient color-deepening effect, and the same otherwise more than 900 parts by weight may result in damage of the feeling of a treated fabric, and further may result in loss of practical utility because of a whitening phenomenon of a fabric owing to the agglomeration of particles.

In the treatment using the present composition, it is possible to use in combination all sorts of chemicals such as glyoxal resin and melamine resin commonly used in fiber treatment, color-control processing agents chiefly including phosphoric acid esters and quaternary ammonium salts, and surface active agents used as penetrants.

The fiber treatment composition of this invention is applied on fabrics or textiles, particularly on dyed fabrics, through processes of padding, nipping and curing as commonly practiced. Usually, the composition of this invention is preferably deposited in the fabric or textile at a level of about 0.2% by weight add-on based on the weight of the goods to be treated. A plural set of padding-nipping operations may optionally added in order to achieve a sufficient add-on or the color-deepening or softening effect. Heating temperatures for curing may desirably be in the range of from 150° to 180° C. in general, but treatment conditions are set in accordance with the properties of textiles or the like to be treated.

EXAMPLES

This invention will be described below in greater detail by giving Examples. In the following, "part(s)" refers to "part(s) by weight" unless otherwise mentioned.

Examples 1 to 3

Comparative Examples 1 and 2

An aqueous dispersion of the organosilasesquioxane containing an epoxy group and an aqueous dispersion of the organopolysiloxane containing an amino group were prepared in the following procedures:

(1) Preparation of aqueous organosilasesquioxane dispersion

A mixture of 180 g of methyltrimethoxysilane with 20 g of glycidoxypropyltrimethoxysilane, 20 g of a cationic surface active agent lauryl trimethylammonium chloride, 20 g of a nonionic surface active agent polyoxyethylene nonylphenyl ether (HLB: 18.5) and 658 g of water were emulsified with use of a homgenizer, and the emulsion was charged into a flask having an internal volume of 2 lit. and equipped with a stirrer, a thermometer and a reflux condenser. Subsequently a solution obtained by dissolving 2 g of sodium hydroxide in 100 g of water was added thereto and thereafter the temperature was raised to 50° C., so that the reaction proceeded without any formation of gels at all. Then the mixture was cooled to 30° C., followed by addition of 3 g of acetic acid to effect neutralization, and the reaction was completed.

The aqueous dispersion thus obtained was a stable emulsion having a bluish white translucent appearance, and, as a result of an analysis, contained silasesquioxane in an amount of 11.7% by weight which is substantially the same as its theoretical amount (11.8% by weight), whose particles were found to be very fine as 98% or more thereof was held by small particles of 0.2 micrometer or less and also the average particle diameter was 0.07 micrometer. The aqueous dispersion obtained is referred to as Dispersion a-1.

(2) Preparation of aqueous dispersion of amino group-containing organopolysiloxane Into a reaction vessel made of glass, having an internal volume of 2 lit. and equipped with a stirrer and a thermometer, 36.6 parts of a disiloxane represented by the formula:

$$MeO-\overset{\overset{\displaystyle A^1}{|}}{\underset{\underset{\displaystyle Me}{|}}{Si}}-O-\overset{\overset{\displaystyle A^1}{|}}{\underset{\underset{\displaystyle Me}{|}}{Si}}-OMe$$

obtained by subjecting to partial hydrolysis an amino group-containing silane represented by the formula:

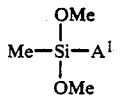

wherein Me represents a methyl group, and $A^1$ represents a group of

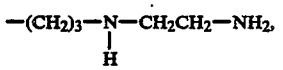

32.0 parts of a cyclic siloxane comprising units of $MeA^1SiO$, obtained by subjecting the above amino group containing silane to hydrolysis using excess water, 1480 parts of octamethylcyclotetrasiloxane and 0.23 part of potassium hydroxide were charged, followed by heating with stirring for 6 hours at 150° C., and thereafter 3.3 parts of epichlorohydrin was added to continue stirring for 1 hour at 100° C. Thereafter, the potassium hydroxide was neutralized to obtain an amino group-containing polysiloxane represented by the formula:

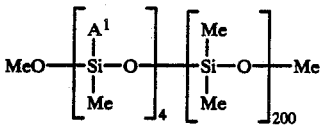

having a viscosity of 750 cSt at 25° C.

To 15 parts of the amino group-containing polysiloxane obtained in the above, 2 parts of a nonionic surface active agent (polyoxyethylene alkylphenyl ether) and 83 parts of water were added, followed by stirring with use of a homogenizer to effect emulsification, thus obtaining an emulsion containing 15% by weight of the above aminogroup-containing polysiloxane. This is referred to as Dispersion b-1.

(3) Preparation of fiber treatment composition

Dispersion a-1 obtained in (1), Dispersion b-1 obtained in (2) and Snowtex-O (trade name; available from Nissan Chemical Industries., Ltd.) which is an aqueous dispersion of an inorganic colloidal silica (concentration: 20% by weight) were mixed in the make-up as shown in Table 1, to prepare compositions of Examples 1 to 3 and Comparative Example 1.

Using these compositions, black-dyed polyester georgette was treated in the following manner. After the operations of dipping the polyester georgette in each composition and then squeezing the composition were repeated twice, followed by drying for 1 minute at 100° C. and then heating for 2 minutes at 150° C. to effect curing. As Comparative Example 2, a polyester georgette same as above was also dipped in mere water, followed by drying and heating in the same manner as in the above.

Properties shown below, of the thus treated polyester georgettes of the respective Examples and Comparative Examples were measured by the methods as shown below to make evaluation. Results obtained are shown in Table 1.

Color tone: Lightness (value L) was measured with use of a differential colorimeter (available from Nippon Denshoku Kogyo K.K.), indicating that the smaller the value L is, the higher the color-deepening effect is.

Feeling: Touched by hands to make evaluation according to the following criterions:

A: Considerably soft with smoothness.

B: Slightly soft.

C: Rough and hard without smoothness.

Color non-uniformity: Evaluated with naked eyes according to the following criterions:

A: No color non-uniformity present.

B: Color non-uniformity present a little.

C: Color non-uniformity present considerably.

Resistance to washing: After aqueous washing was repeated three times according to the method 103 prescribed in JIS L-0217, the color tone and feeling were measured according to the above methods to make evaluation.

TABLE 1

| | Examples | | | Comparative Examples | |
|---|---|---|---|---|---|
| | 1 | 2 | 3 | 1 | 2 |
| Make-up (parts): | | | | | |
| Dispersion a-1 | 1 | 2 | 2 | — | — |
| Dispersion b-1 | 2 | 4 | 2 | 2 | — |
| Snowtex-O | — | — | — | 2 | — |
| Water | 97 | 94 | 96 | 96 | 100 |
| Properties: | | | | | |
| Lightness (Value L) | 9.8 | 9.6 | 9.6 | 9.8 | 12.0 |
| Feeling | A | A | A | C | C |
| Color non-uniformity | A | A | A | C | — |
| After washing three times; | | | | | |
| Lightness | 10.0 | 9.7 | 9.6 | 10.0 | 12.1 |
| Feeling | B | A | A | C | — |

Examples 4, 5

(1) Preparation of aqueous dispersion of amino group-containing organopolysiloxane An emulsion was prepared by emulsion polymerization in the following manner and from the following components (a) to (f).

Component (a): Octamethylcyclotetrasiloxane 300 g

Component (b): A cyclic aminosiloxane 3 g represented by the formula:

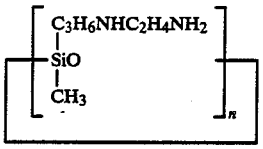

wherein n is an integer of 3 to 6 (a mixture).

Component (c): Methyltrimethoxysilane 3 g

Component (d): Lauryltrimethylammonium chloride 30 g Polyoxyethylene nonyl phenyl ether 3 g Component (e): Potassium hydroxide 1 g Component (f): Acetic acid 2 g Phosphoric cid 0.2 g In a 2 lit. glass beaker, components (a), (b) and (c) of the above were charged, and uniformly dissolved by means of a homomixer, followed by addition of component (d) and 641 g of water to uniformly effect emulsification. Next, to the resulting emulsified product, a solution obtained by dissolving the above component (e) in 19 g of water was added, followed by heating for 72 hours at 70° C. to carry out polymerization and thereafter neutralization using component (f) to prepare an emulsion. The emulsion obtained had 29.8% by weight of nonvolatile content after maintained for 3 hours at 105° C., and a residue thereof comprised a soft rubbery film. This emulsion is referred to as Dispersion b-2.

(2) Preparation of fiber treatment composition

Dispersion a-1 previously described and Dispersion b-2 prepared in (1) were mixed in the manner as shown in Table 2 to prepare compositions of Examples 4 and 5. black-dyed polyester georgettes were treated in the same manner as in Examples 1 to 3, and the properties were measured to make evaluation. Results obtained are shown in Table 2.

TABLE 2

| | Example 4 | Example 5 |
|---|---|---|
| Make-up (parts): | | |
| Dispersion a-1 | 1 | 2 |
| Dispersion b-2 | 1 | 2 |
| Water | 98 | 96 |
| Properties: | | |
| Immediately after treatment; | | |
| Value L | 9.4 | 9.2 |
| Feeling | A | A |
| Color non-uniformity | A | A |
| After washing three times; | | |
| Value L | 9.4 | 9.2 |
| Feeling | A | A |

Example 6

Comparative Example 3

(1) Preparation of aqueous dispersion of organosilasesquioxane

An aqueous dispersion of organosilasesquioxane (concentration: 11.5% by weight) was prepared in the same manner as in (1) of Example 1 except that 200 g of methyltrimethoxysilane was used in place of the mixture of methyltrimethoxysilane with glycidoxypropyltrimethoxysilane. This is designated as Dispersion a-2.

(2) Preparation of fiber treatment composition

Using Dispersion b-2 previously described and Dispersion a-1 or Dispersion a-2 in combination, prepared were compositions of Example 6 and Comparative Example 3 as shown in Table 3. In the same manner as in Examples 1 to 3, black-dyed polyester georgettes were treated and the color tone (value L) and feeling of these fabrics were evaluated. Results obtained are shown in Table 3.

TABLE 3

| | Example 6 | Comparative Example 3 |
|---|---|---|
| Make-up (parts): | | |
| Dispersion a-1 | 3 | — |
| Dispersion b-2 | 2 | 2 |
| Dispersion a-2 | — | 3 |
| Water | 95 | 95 |
| Properties: | | |
| Immediately after treatment; | | |
| Value L | 8.9 | 9.0 |
| Feeling | A | A |
| After washing three times; | | |
| Value L | 9.0 | 11.2 |
| Feeling | A | A |

The above results tell that the composition using the organosilasesquioxane having no epoxy group shows a low washing resistance of the color-deepening effect, but the composition of this invention has a good washing resistance.

Examples 7 and 8

(1) Preparation of aqueous dispersion of organosilasesquioxane

Using an anionic emulsifying agent, an aqueous dispersion of organosilasesquioxane containing an epoxy group was prepared in the following manner.

Emulsified using a homogenizer were 180 g of methyltrimethoxysilane, 20 g of glycidoxypropyltrimethoxysilane, 10 g of sodium lauryl sulfate as an anionic emulsifying agent, 15 g of polyoxyethylene nonylphenyl ether (HLB: 18.5) as a nonionic emulsifying agent and 673 g of water. The procedures posterior to the step of charging the resulting emulsified product into a flask exactly followed what were described in (1) of Example 1, to obtain an aqueous dispersion containing 11.6% by weight of organosilasesquioxane containing an epoxy group and comprising particles having an average particle diameter of 0.15 micrometer. This is designated as Dispersion a-3.

(2) Preparation of fiber treatment composition

Using Dispersion b-1 previously described and Dispersion a-1 or Dispersion a-3 in combination, prepared were compositions as shown in Table 4, and, using black-dyed polyester georgettes, the color tone (value L), feeling and color non-uniformity, and the washing resistance of the color tone and feeling were evaluated in the same manner as in Examples 1 to 3. Results obtained are shown in Table 4.

TABLE 4

| | Example 7 | Example 8 |
|---|---|---|
| Make-up (parts): | | |
| Dispersion a-1 | 3 | — |
| Dispersion b-1 | 3 | 3 |
| Dispersion a-3 | — | 3 |
| Water | 94 | 94 |
| Properties: | | |
| Immediately after treatment; | | |
| Value L | 9.0 | 8.9 |
| Feeling | A | A |
| Color non-uniformity | A | A |
| After washing three times; | | |
| Value L | 9.1 | 9.1 |
| Feeling | A | A |

What is claimed is:

1. A fiber treatment composition comprising an aqueous dispersion containing;

(A) 100 parts by weight of a finely particulate epoxy group-containing organosilasesquioxane substantially represented by general unit formula (I):

$$R^1SiO_{3/2} \quad (I)$$

wherein $R^1$ is an admixture of a monovalent hydrocarbon group having 1 to 20 carbon atoms which may be substituted with a halogen atom, and a monovalent organic group having an epoxy group, and said organic group having an epoxy group comprises from 0.1 to 50 mol % of the whole $R^1$; and;

(B) from 10 to 900 parts by weight of an amino group-containing organopolysiloxane represented by general unit formula (II):

$$(R^2)_aZ_bSiO_{\frac{4-a-b}{2}} \quad \text{(II)}$$

wherein $R^2$ is at least one group selected from the group consisting of a monovalent hydrocarbon group having 1 to 20 carbon atoms which may be substituted with a halogen atom and a group represented by the formula —$OR^3$ where $R^3$ is an alkyl group having 1 to 5 carbo atoms or a hydrogen atom; Z is a group represented by formula (III):

$$-R^4-\overset{\overset{R^5}{|}}{N}-(CH_2CH_2\overset{\overset{R^6}{|}}{N})_c-R^7 \quad \text{(III)}$$

where $R^4$ is a divalent hydrocarbon group having 1 to 6 carbon atoms, $R^5$, $R^6$ and $R^7$ may be the same or different and each are a hydrogen atom or a monovalent hydrocarbon group having 1 to 20 carbon atoms, and c is an integer of 0 to 3; and a and b are numbers satisfying $1<a<3$, $0<b<1$ and $1<a+b<3$; and having at least one said group Z in its molecule.

2. The composition of claim 1, wheren $R^1$ in formula (I) is a glycidoxypropyl group or a beta-(3,4-epoxycyclohexyl)ethyl group.

3. The composition of claim 1, wherein said organic group having an epoxy group comprises 0.5 to 10 mol % of the whole $R^1$ in formula (I).

4. The composition of claim 1, wherein the component (A) organosilasesquioxane has a particle diameter of 0.5 micrometer or less.

5. The composition of claim 4, wherein the component (A) organosilasesquioxane has a particle diameter of from 0.01 to 0.3 micrometer.

6. The composition of claim 1, wherein said aqueous dispersion containing the component (A) organosilasesquioxane is prepared by a method comprising a step of forming the organosilasesquioxane by subjecting a starting material selected from the group consisting of a hydrolyzable silane represented by the formula:

$$R^1SiX_3$$

wherein $R^1$ is as defined in claim 1, and X is a hydrolyzable organic group, and a partial-hydrolysis-condensation product thereof, to emulsification with stirring in the presence of any combination of (1) a cationic emulsifying agent with a nonionic emulsifying agent or (2) an anionic emulsifying agent with a nonionic emulsifying agent, followed by polymerization in the presence of an alkaline material, thereby said organosilasesquioxane being produced.

7. The composition of claim 1, wherein 50 mol % or more of the whole $R^2$ in said formula (II) representing component (B) is held by a methyl group.

8. The composition of claim 7, wherein 80 mol % or more of the whole $R^2$ in said formula (II) representing component (B) is held by a methyl group.

9. The composition of claim 1, which comprises 100 parts by weight of said component (A) and 50 to 300 parts by weight of said component (B).

* * * * *